United States Patent [19]

Campbell

[11] 4,246,941

[45] Jan. 27, 1981

[54] WOOD SPLITTER APPARATUS

[76] Inventor: A. C. Campbell, Rte. 2, Box 45, Westminster, S.C. 29693

[21] Appl. No.: 970,890

[22] Filed: Dec. 19, 1978

[51] Int. Cl.[3] ..... B27L 7/00

[52] U.S. Cl. ..... 144/193 B; 173/124

[58] Field of Search ..... 173/124; 144/193 R, 144/193 B

[56] References Cited

U.S. PATENT DOCUMENTS

| | | | |
|---|---|---|---|
| 715,177 | 12/1902 | Thomas | 173/124 X |
| 829,594 | 8/1906 | Massey | 144/193 B |
| 875,559 | 12/1907 | Sorrells | 173/124 X |
| 918,944 | 4/1909 | Aunes | 144/193 B |
| 1,701,001 | 2/1929 | Hampton | 144/193 B |

*Primary Examiner*—W. Donald Bray
*Attorney, Agent, or Firm*—Bailey, Dority & Flint

[57] ABSTRACT

A wood splitter apparatus in which a wedge is fixed to a weight mounted slidably on two vertical spaced support tubes. A link chain is fixed to the weight and fitted over a sprocket pulley at the top of the support tubes to which a pulley and engine is fixed by a clutch. A first latch is pivotally mounted to a support tube so as to automatically latch the weight in the upwards position when the weight is lifted past the latch. A clutch lever is pivotally mounted to the support tube so as to be engaged by a bolt fixed to the weight, when the weight is lifted above the latched position, with the clutch lever, when engaged, serving to disengage the clutch. A second latch is pivotally supported to the structure so as to be automatically positioned to a latched position to hold the weight in the upward position. A rotary spring coil take-up reel is attached by a flexible rope to the link chain to maintain the chain under tension about the sprocket pulley. The weight, when in the latched upward position, is manually released by manual operation of the first latch and manual operation of the second latch, with the clutch automatically maintained in the disengaged position while the weight and attached wood splitter wedge drops.

4 Claims, 4 Drawing Figures

18
111
18
67
69
67
96
213
35
113
41
101
65
63
112
115
222
64
221
86
110
23
79
108
97
111
96
102
87
62
43
53
72
75
42
221
106
89
81
61
103
53
33
10
86
104
61
75
39
119
89
32
55
31
55
108
62
44
103
97
121
33
106
70
54
57
10
56
11
116
53
115
37
69
67
31
121
64
108
54
103
55
11
121
54

WOOD SPLITTER APPARATUS

PRIOR ART

The inventor is aware of the following U.S. Pat. Nos. which describe apparatus of a similar nature: 1,231,525; 1,626,152; 1,701,001; 2,704,093; 3,834,436; 3,865,163; 3,097,676; 3,937,260; 3,982,572; and 4,033,390. None of these patents suggest apparatus of the simplicity and effective nature of the applicant's invention.

SUMMARY OF THE INVENTION

My invention is a wood splitter apparatus in which a wedge is fixed to a weighted assembly mounted slidably on two vertical spaced support tubes. A link chain is fixed to the weight and fitted over a sprocket pulley at the top of the support tubes to which a pulley and engine is fixed by a clutch. A first latch is pivotally mounted to a support tube so as to automatically latch the weight in the upwards position when the weight is lifted past the latch. A clutch lever is pivotally mounted to the support tube so as to be engaged by a bolt fixed to the weighted assembly when the weighted assembly is lifted above the latched position, with the clutch lever, when so engaged, serving to disengage the clutch. A second latch is pivotally supported to the structure so as to be automatically positioned by spring bias to a latched position to hold the weight in the upward position. A rotary spring coil take-up reel is attached by a flexible rope to the link chain to maintain the chain under tension about the sprocket pulley. The weight, when in the latched upward position, is manually released to fall, by manual operation of the both latches. The clutch lever is automatically maintained in the disengaged position with manual operation of the clutch lever serving to engage the clutch when the weighted assembly is to be elevated.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figures 1, 2, 4:
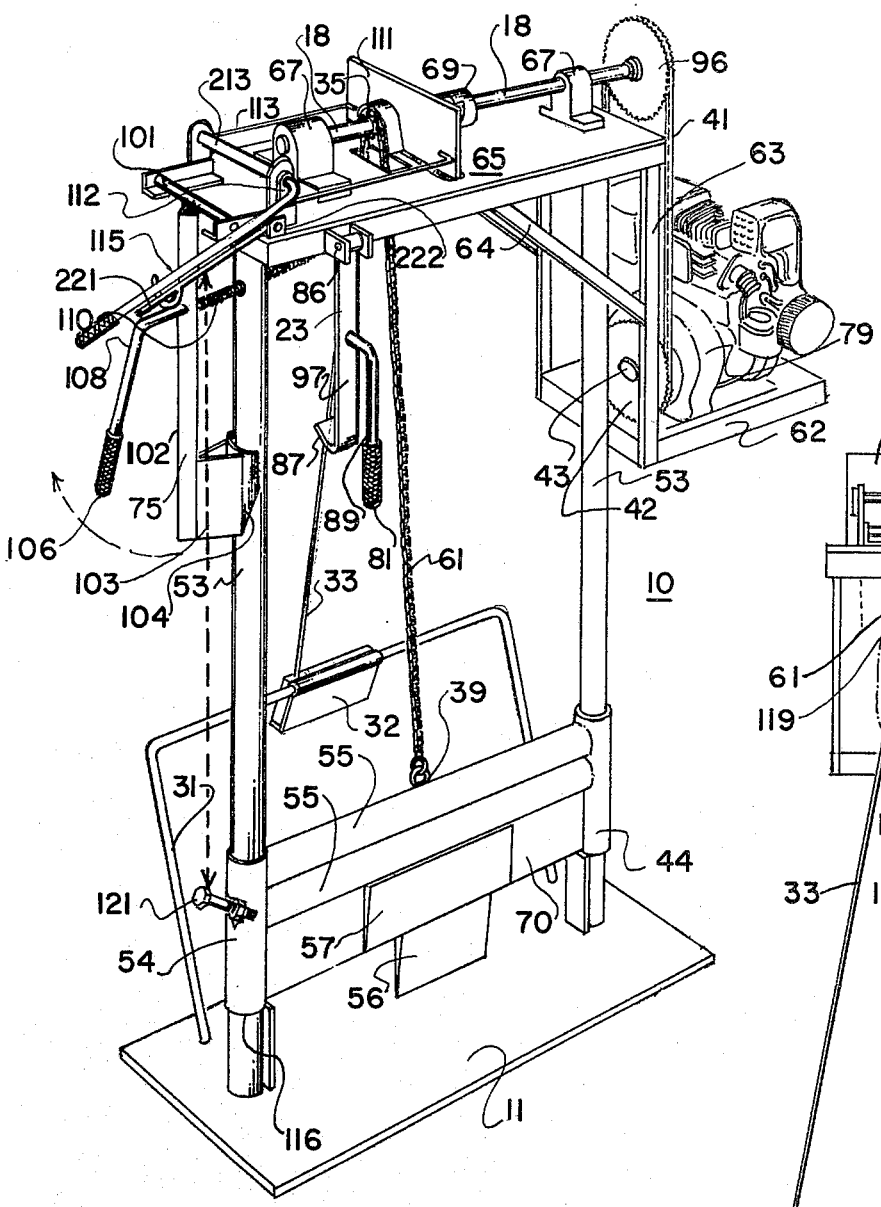
FIG. 1 is a perspective view of the invention.
FIG. 2 is a side view of the invention.
FIG. 4 is a detail elevation view of the invention with the blade in the up position.
Figure 3:
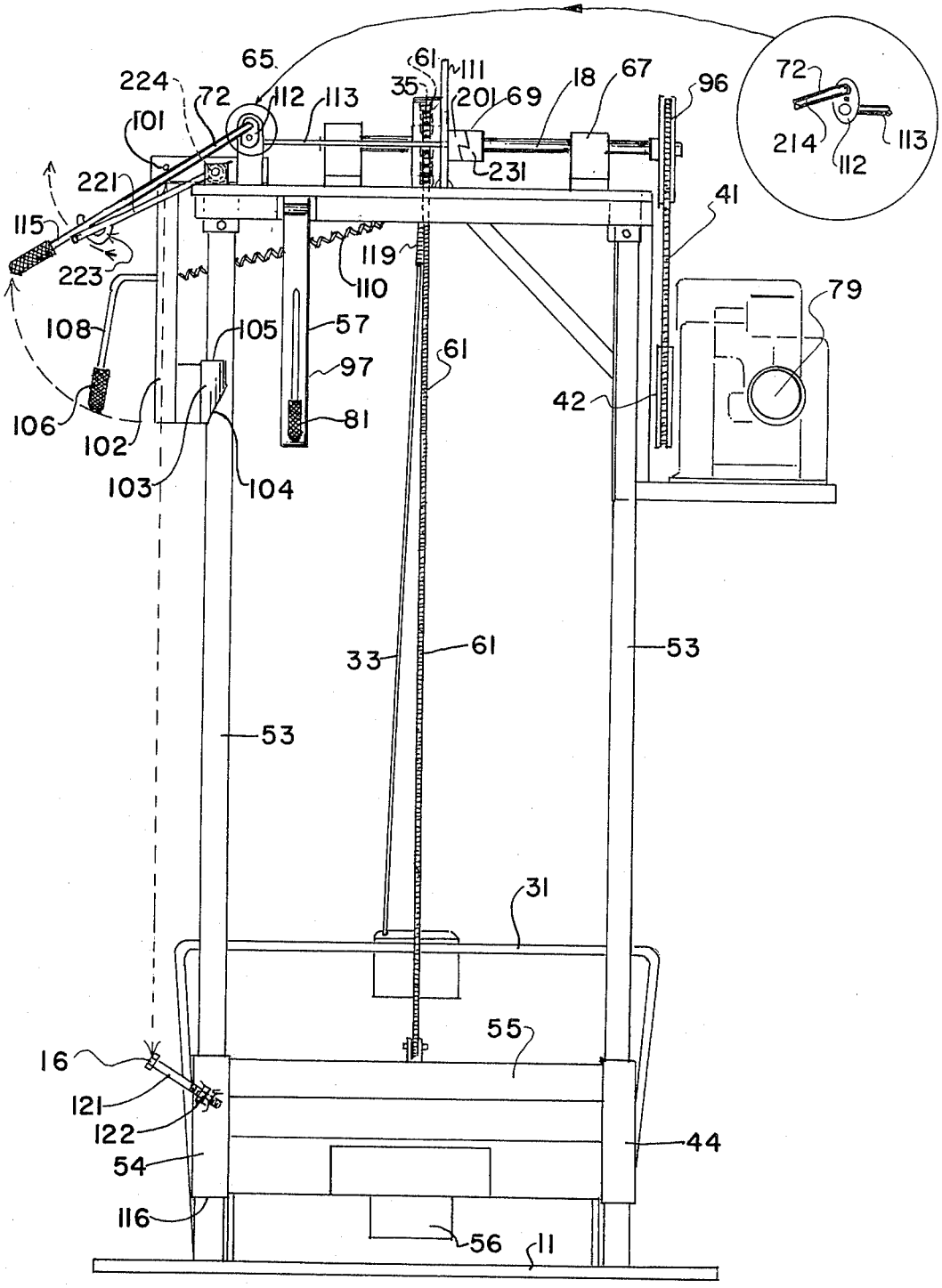
FIG. 3 is an elevation view of the invention.

Turning now descriptively to the drawings, in which similar reference characters denote similar elements throughout the several views, FIGS. 1–4 illustrate the device 10 which is mounted on a flat plate base 11 to which two spaced parallel vertical cylindrical tubes 53 are fixed, with tubes 53 being fixed at their upper extremities to platform 65. A base plate 62, for mounting of an engine 79, is suspended from platform 65 by hangars 63 and braces 64. Engine 79 is linked by a chain or belt drive 41 about sprocket gear 42, fixed to engine shaft 43, and sprocket gear 96 mounted to an axle shaft 18 rotatably supported in bearings 67 on platform 65 and fixed to one rachet gear 201 of clutch 69.

A weighted assembly 70 is formed of weighted members 55 that are joined together and at each end to sleeves 54 and 44 which freely slide over tubes 53. A wedge bar 57 is fixed below lowermost member 55 to sleeves 54 and 44 and extended wedge 56 projects below wedge bar 57 for splitting of wood (not shown) on base 11 when struck by wedge 56.

A link or roller chain 61 is fastened by an eye 39 to upper weighted member 55 with chain 61 extending upwards over a sprocket gear 35 freely mounted about shaft 18 which gear 35 is joined to clutch gear 231, so that when gear 231 is rotated, in the engaged position of clutch 69 by shaft 18 and engine 79, chain 61 pulls member 55 and wedges 56, 57 upwards. An end 119 of chain 61 is fastened to flexible rope 33 with rope 33 being wound about spring wound reel 32 so as to apply sufficient tension on chain 61 at all times to maintain chain 61 in engagement with sprocket gear 35. However, the tension applied by reel 32 to chain 61 is inconsequential as applied to the weight of members 55 so that in the disengaged position of clutch 69, and when unlatched as described hereinafter, slidable weight assembly 70, comprising member 55 and wedge 56, will fall as a unit relatively freely. Reel 32 is fixed to a U-shaped support bracket 31 extending from base 11 that clears the middle section of plate 11 between posts 53 so that a log to be split may be placed between posts 53 under wedge 56.

A safety latch unit 97 for automatic latching of the slidable weight assembly 70 is pivotally mounted on pin 86 in a bracket extending from top platform 65 with latch unit 97 formed of a blade 23 terminating in a hook section 87 of a shape to fit under and engage the lower surface of wedge bar 57 in the upper position of weight assembly 70, shown in FIG. 4. A handle section 89 is fixed to blade 23 so that latch unit 97 may be manually pivoted to either the engaged or disengaged position by the user manipulating the grip 81 of handle section 89.

Handle section 89 extends from blade 23 so as to balance the blade 97 about pivot 86 to extend the hook section 87 towards the plane of travel of weighted member 70 so that the hook section will extend automatically under the lower surface of wedge bar 57 as the weighted assembly is raised to the elevated position with hook section 87 tapered to permit the operator to manually pivot the hook section out of engagement with the wedge bar, as desired, by manual pressure applied to grip 81 of lever 89. Alternatively, blade 97 may be biased by a spring so as to pivot towards the plane of travel.

An automatic latch unit 75 is pivotally mounted by pin 101 to platform 65, with vertical channel 102 welded to pin 101 and fixed at its lower end to shaped bracket 103 that fits partially about the exterior of a vertical tube 53. The lower interior corner 104 of bracket 103 is tapered so as to enable bracket 103 to slide about sleeve 54 as the weight members 55 are elevated with the upper horizontal edge 105 of bracket 103 fitting under the lower edge 116 of sleeve 54 to prevent the weighted member from falling once the weighted member has been lifted by chain 61 above bracket 103. Latch unit 75 may be manually released by grasping grip 106 of handle 108 fixed to vertical channel 102 and swinging the latch unit about pivot pin 101 away from the sleeve 54. A tension spring 110 is fixed to channel 102 and platform 65 to bias vertical channel 102 to the latched position, as shown.

Clutch 69 is of the one-way directional type and is formed of a first rachet toothed gear 231 fixed to shaft 18 and a second rachet toothed gear 201 freely mounted about shaft 18 so as to be free to slide and to rotate relative to shaft 18. Gear 201 is fixed to sprocket gear 35 which is also freely mounted about shaft 18 and clutch plate 111 is mounted between gears 201 and 35 freely of both gears and shaft 18 such that plate 111 may bear against gear 201 when slid towards gear 201 to cause gear 201 to engage with gear 231, while the sliding of plate 111 away from gear 201 and against gear 35 caused gear 201 to be slid out of engagement with gear 231.

In the engaged positions of gears 201 and 231, sprocket gear 35 rotates to cause chain 61 to lift the weighted member 55 when shaft 18 is driven by engine 79, while in the disengaged position of these gears, sprocket gear 35 and chain 61 is independent of the rotation of shaft 18 so that the weighted member may be fixed in either the upper of lower position or so that the weighted member may freely fall from the upper to the lower position.

Clutch plate 111 is fixed by bars 113 each of which is pivotally fixed to a cam 112 that is fixed to shaft 213 of clutch lever 72, with lever handle section 214 bent at right angles to shaft 213. Upward elevation of lever handle section 214 rotates shaft 213 so as to rotate cams 112 and slide plate 11 to the disengaged clutch position. Shaft 213 is pivotally mounted in brackets fixed to platform 65. The handle section 214 is normally biased upwards to rotate shaft 213 so as to bias the clutch in the disengaged position by flange 223 of the clutch lock-out lever lifting the handle section 214 as described hereinafter.

A screw 121 is threaded to a nut 122 fixed to sleeve 54 and located so that when members 55 are pulled to the automatic latched position shown in FIG. 4, the head of screw 121 engages a clutch lock-out 221 pivotally mounted to a bracket 222 so as to extend to the side of the apparatus. A flange 223 on lever 221 extends under lever 72, with lever 221 biased upwards by a torsion spring 224 so as to cause flange 223 to bear against lever 72. When screw 121 engages lever 221, it causes lever flange 223 to raise lever 72 to positively rotate it to the disengaged position of clutch 69. Screw 121 may be rotated in nut 122 so as to be adjusted to precisely the correct length so that the clutch is disengaged after edge 105 of latch bracket 103 supports edge 106 of sleeve 54 in the latched position of latch assembly 75, when member 55 is elevated. Spring 224 is of sufficient strength to bias the clutch lever to the disengaged position, once the clutch lever has been elevated to the disengaged position.

Once the weighted member 55 and wedge 56 is latched in the elevated position shown in FIG. 4 and a log is placed on base 11 directly under wedge 56, the wedge and weighted members are manually released by the operator manually holding safety latch lever 89 by grip 81 in the disengaged clutch position and simultaneously elevating latch lever 108 by grip 106 to release the weighted member which then slides downwards to strike and split such a log. Upon the operator manually gripping clutch lever 72 manually rotating clutch lever 72 downwards, against the bias of torsion spring 224, the engine rotation causes the chain 61 to elevate the weighted member to the automatically latched position. Reel 32 and rope 33 maintains sufficient tension bias on chain 61 to keep chain 61 engaged to sprocket gear 35 without appreciably retarding the free fall of the weighted member and wedge.

A safety feature of the apparatus lies in the necessity for the operator to stand out of range of travel of the weighted member with one hand grasping grip 89 of safety lever 72 and the other hand holding grip 106 of lever 108 in order to release the weighted member to permit it to fall.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. Apparatus for splitting wood comprising:
- a frame;
- sleeve means slidably carried by said frame;
- a weighted member fixed to said sleeve means;
- a wedge member carried by said weighted member for splitting wood;
- engine means operatively connected to said weighted member for raising said weighted member to an elevated position;
- clutch means operatively connected to said engine means having a release position in which said weighted member is released from said operative connection with said engine means;
- control means for shifting said clutch means to an engaged position in which said engine means is operatively connected to said weighted member and to said release portion for releasing said clutch means;
- latch means carried by said frame to retain said weighted member in said elevated position; and
- an adjustable engagement device carried by said sleeve means so as to engage said control member of the clutch means in said elevated position of said weighted member so as to cause said clutch means to be shifted to said release position automatically upon arrival of said weighted member at said elevated position.

2. The apparatus of claim 1 wherein said latch means includes movable bracket means carried by said frame having a first position in which said bracket means holds said weighted member in said elevated position, said bracket means being engaged by said sleeve means and moved to a second position allowing said weighted member to move to said elevated position, said bracket means returnable thereafter to said first position.

3. The apparatus of claim 2 wherein said bracket means includes a bracket section having a tapered edge engaged by said sleeve means during upward movement thereof to move said bracket means to said second position. said bracket section having an upper edge upon which said sleeve means is supported and retained in said elevated position.

4. The apparatus of claim 1 wherein said latch means includes a pivotable blade carried by said frame having a lower hook section shaped so as to automatically receive a portion of said weighted member and wedge when raised to said elevated position preventing said weighted member from falling from said elevated position.

* * * * *